US006621470B1

(12) United States Patent
Boeringer et al.

(10) Patent No.: US 6,621,470 B1
(45) Date of Patent: Sep. 16, 2003

(54) TILED PHASED ARRAY ANTENNA

(75) Inventors: Daniel Wilharm Boeringer, Silver Spring, MD (US); Richard S. Konapelsky, Columbia, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 169 days.

(21) Appl. No.: 09/910,715

(22) Filed: Jul. 24, 2001

Related U.S. Application Data

(63) Continuation of application No. 09/815,756, filed on Mar. 23, 2001, now abandoned.

(51) Int. Cl.[7] ..... H01Q 21/00

(52) U.S. Cl. ..... 343/853; 343/700 MS; 343/878; 343/DIG. 2

(58) Field of Search ..... 343/700 MS, 829, 343/846, 853, 878, DIG. 2; H01Q 1/20, 1/38, 21/00

(56) References Cited

U.S. PATENT DOCUMENTS 5,870,063 A * 2/1999 Cherrette et al. ..... 343/853
6,078,289 A * 6/2000 Manoogian et al. ..... 342/373
6,114,997 A * 9/2000 Lee et al. ..... 343/700 MS
6,166,705 A * 12/2000 Mast et al. ..... 343/853
6,297,775 B1 * 10/2001 Haws et al. ..... 343/700 MS
6,515,636 B2 * 2/2003 Munder et al. ..... 343/878

OTHER PUBLICATIONS

Tilings and Patterns, Branko Grunbaum, University of Washington, G.C. Shephard, University of East Anglia, W.H. Freeman and Company, New York, pp. 20–25, 121–123, and 512–518.

* cited by examiner

*Primary Examiner*—Tho G. Phan
(74) *Attorney, Agent, or Firm*—Birch, Stewart, Kolasch & Birch, LLP

(57) ABSTRACT

A phased array antenna consisting of like multi-element tiles whose elements are located so as to produce an irregular array when the tiles have mutually different orientations, e.g., random. The resulting irregular array reduces the effective translational period of the array elements, which in turn ameliorates grating lobes even for wide (one wavelength) effective element spacings. An antenna so designed can maintain low peak sidelobes at far higher frequencies than a conventional translational-periodic phased array antenna of the same element density.

26 Claims, 13 Drawing Sheets

TILED PHASED ARRAY ANTENNA

This application is a continuation of application No. 09/815,756 filed Mar. 23, 2001 now abandoned.

BACKGROUND OF THE INVENTION

1. Field of the Invention

This invention relates generally to phased array antennas and more particularly to an antenna configuration which ameliorates grating lobes while having wide effective element spacings on the order of one wavelength.

2. Description of Related Art

Phased array antennas are well known and provide excellent electronic beam steering capabilities. However, such antennas require expensive electronics, such as phase shifters, circulators, amplifiers, etc. associated with each radiating element. To reduce manufacturing costs, antenna element support members such as tiles have recently been developed, each incorporating multiple elements. Where identical tiles are utilized, cost savings can result because such tiles can be mass produced. To further reduce antenna cost, it has become desirable to reduce the element count as much as possible while still providing the same desired aperture size; however, when element spacing exceeds one half wavelength in any regular grid of antenna elements, grating lobes appear when the beam is scanned. In general, element count can be reduced by global random thinning or aperiodic element locations, but such approaches do not lend themselves to tiling and hence do not realize the full cost savings potential of mass production.

SUMNMARY

Accordingly, it is an object of the present invention to provide an improvement in phased array antennas having wide element spacings.

It is yet another object of the invention to provide an antenna which maintains low peak sidelobes at far higher operating frequencies than a conventional translational-periodic phased array antenna having the same element density.

It is still a further object of the invention to provide a phased array antenna which substantially reduces or eliminates grating lobes while having element spacings which exceeds one half wavelength.

It is yet a further object of the invention to provide a tiled phased array antenna which ameliorates grating lobes for effective element spacings on the order of one wavelength.

The foregoing and other objects are achieved by a phased antenna array comprised of an arrangement of like contiguous tiles in the form of a regular polygon having an identical number and relative positioning of antenna elements which by a judicious choice of tile element positions combined with tile rotations result in an irregular or aperiodic array so as to reduce the effective translational period of the array elements which ameliorates grating lobes for elements having an average density of one per square wavelength, i.e., one wavelength spacing. This is achieved, in one aspect of the invention, by randomly orienting a set of square tiles having, for example, four antenna elements located thereon where two of the antenna elements are aligned with a diagonal of the respective tile, and where the other two elements are equi-distantly located on either side of the diagonal. In one tile embodiment, the first two elements are located in the region adjacent one corner of the tile while the other two elements are located in the region adjacent an opposite corner of the tile. In a second tile embodiment, one element of the four antenna elements is located in the region adjacent one corner of the tile along the diagonal while the other three elements are aligned linearly across a diagonal in a region adjacent the opposite corner of the tile.

Further scope of applicability of the present invention will become apparent from the detailed description provided hereinafter. It should be understood, however, that the detailed description and specific embodiments, while disclosing the preferred embodiments of the invention, are provided by way of illustration only inasmuch as various changes and modifications coming within the spirit and scope of the invention will become apparent to those skilled in the art from the detailed description which follows.

BRIEF DESCRIPTION OF THE DRAWINGS

The present invention will become more fully understood when the following detailed description is considered in conjunction with the accompanying drawings, which are provided by way of illustration only, and thus are not meant to be limitative of the present invention, and wherein.

DESCRIPTION OF THE PREFERRED EMBODIMENTS

Figure 1:
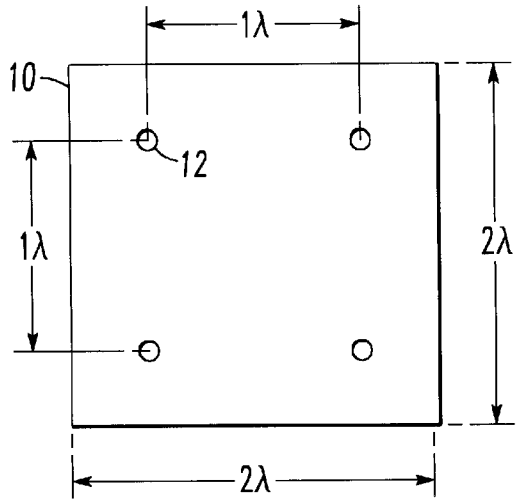
FIG. 1 PRIOR ART
FIG. 1 is illustrative of a rectangular four element tile arrangement utilized for implementing a square grid, and having a one wavelength spacing.

Referring now to the drawing figures where like reference numerals refer to like parts throughout, reference is first made to FIG. 1 which is illustrative of a support member consisting of a tile 10 having the shape of a regular polygon and, more particularly, a square including four antenna elements arranged in a conventional square configuration and having a spacing of one wavelength (1λ). As shown, the tile 10 has a total size of 2λ×2λ or four square wavelengths. Since there are four elements 12 per tile 10, the effective spacing is one wavelength.

Figure 2:
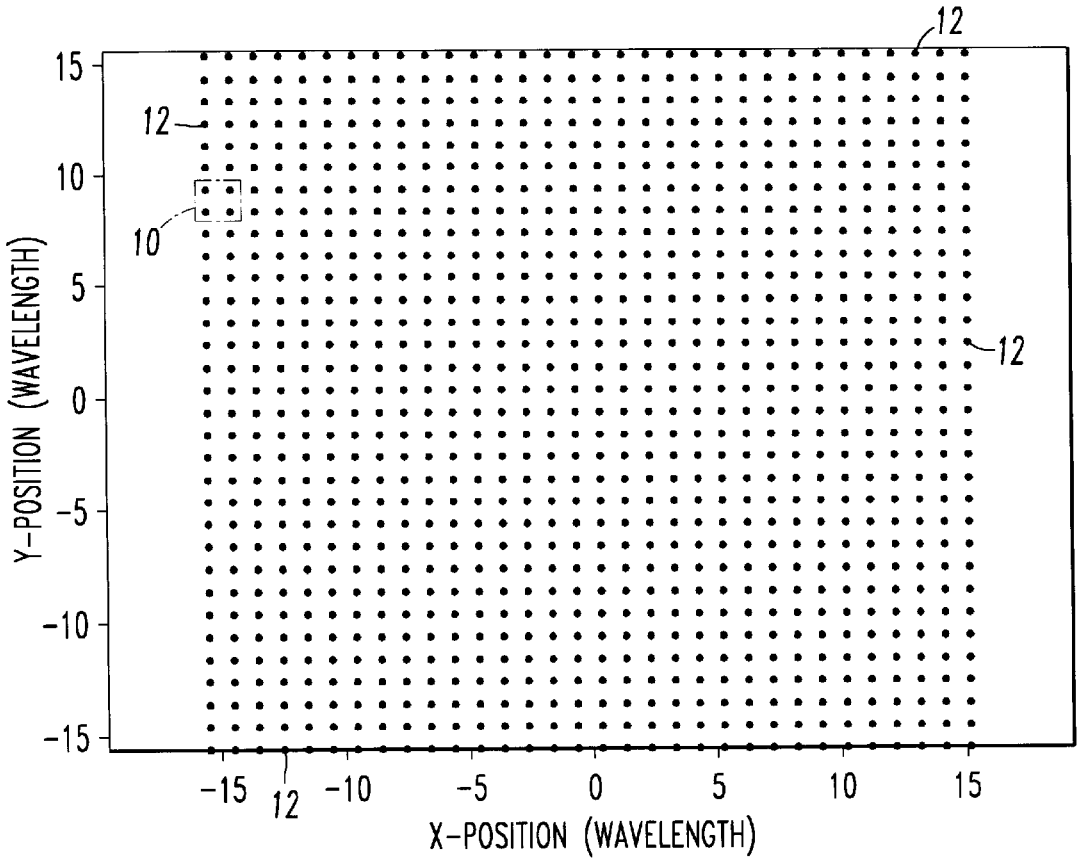
FIG. 2 PRIOR ART
FIG. 2 is illustrative of a regular array of tiles, such as shown in FIG. 1, implementing a one wavelength square grid.
Figure 3:
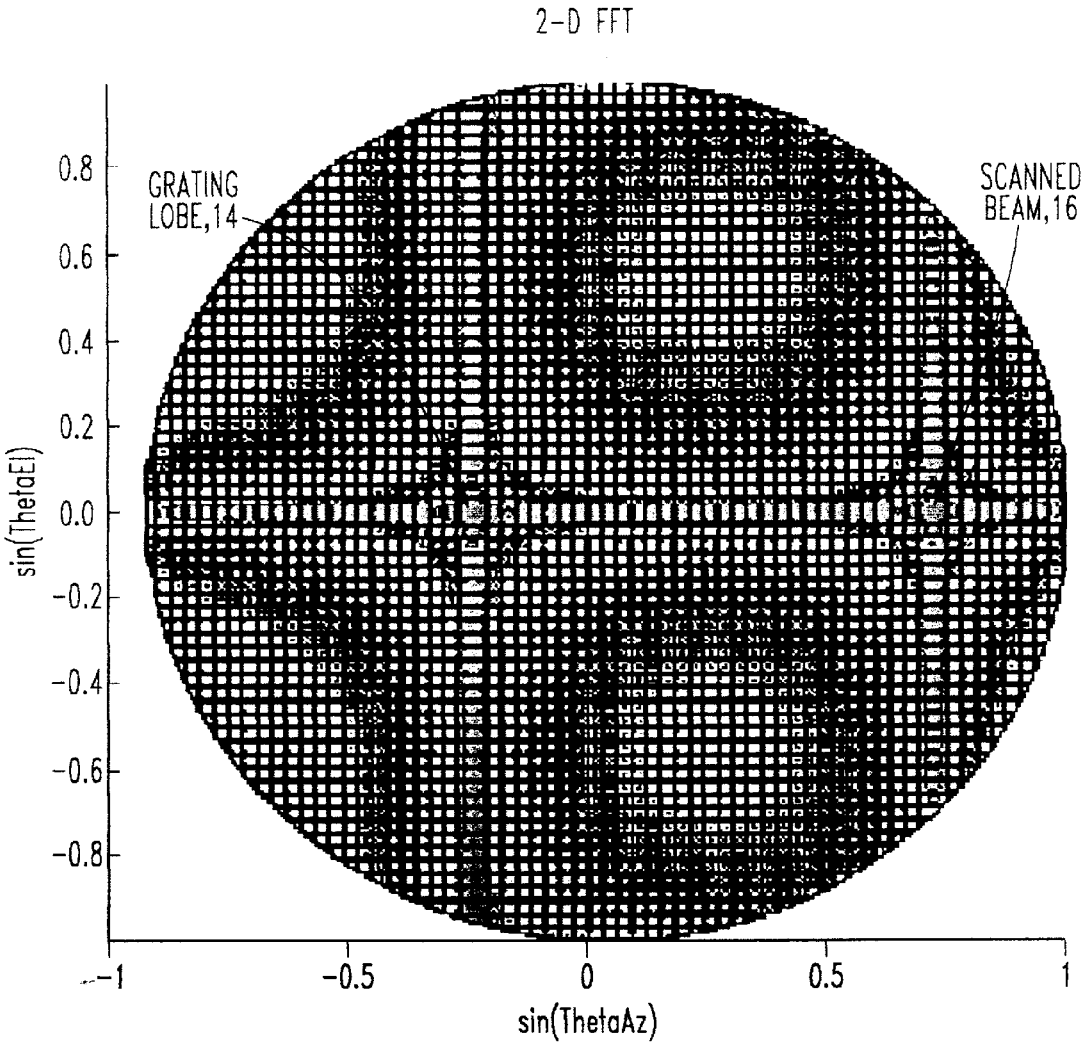
FIG.3 PRIOR ART
FIG. 3 is a depiction of the scan beam and the grating lobes which appear when the regularly spaced array shown in FIG. 2 is scanned, for example, 45° in azimuth.

A 16×16 array of tiles shown in FIG. 1 yields a square array of 1024 elements on a one wavelength (1λ) square grid as shown in FIG. 2. When an array such as shown in FIG. 2 having regular element spacing on the order of one wavelength is scanned, for example 45° in azimuth, the array has a two dimensional far field radiation pattern (2-D FFT) as shown in FIG. 3. It can be seen with respect to FIG. 3 that a relatively large grating lobe 14 is formed near boresight 16, which is undesirable.

These grating lobes can be ameliorated, i.e., substantially reduced, if not eliminated, by arranging the radiating elements of an antenna tile array so that an irregular array is provided when combined with copies of the same tile having mutually different orientations.

Figure 4:
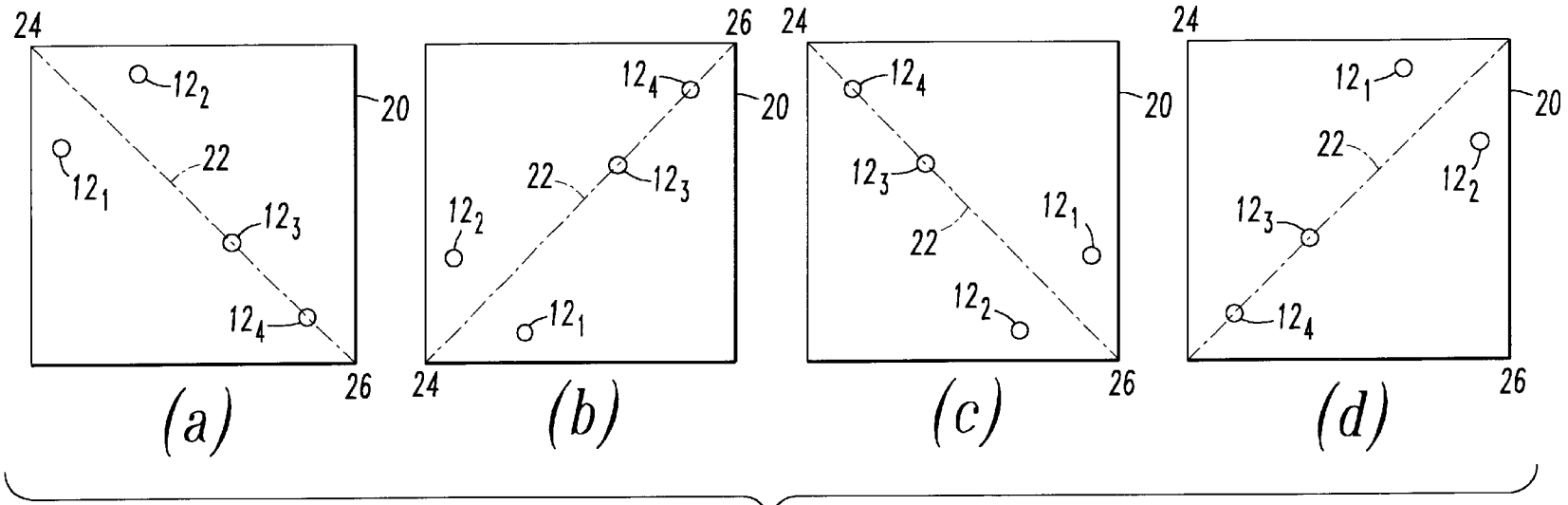
FIGS. 4*a*–4*d* are illustrative of a first embodiment of a four element tile in accordance with a first embodiment of the subject invention and further illustrative of four possible 90° rotations or orientations thereof.
Figure 5:
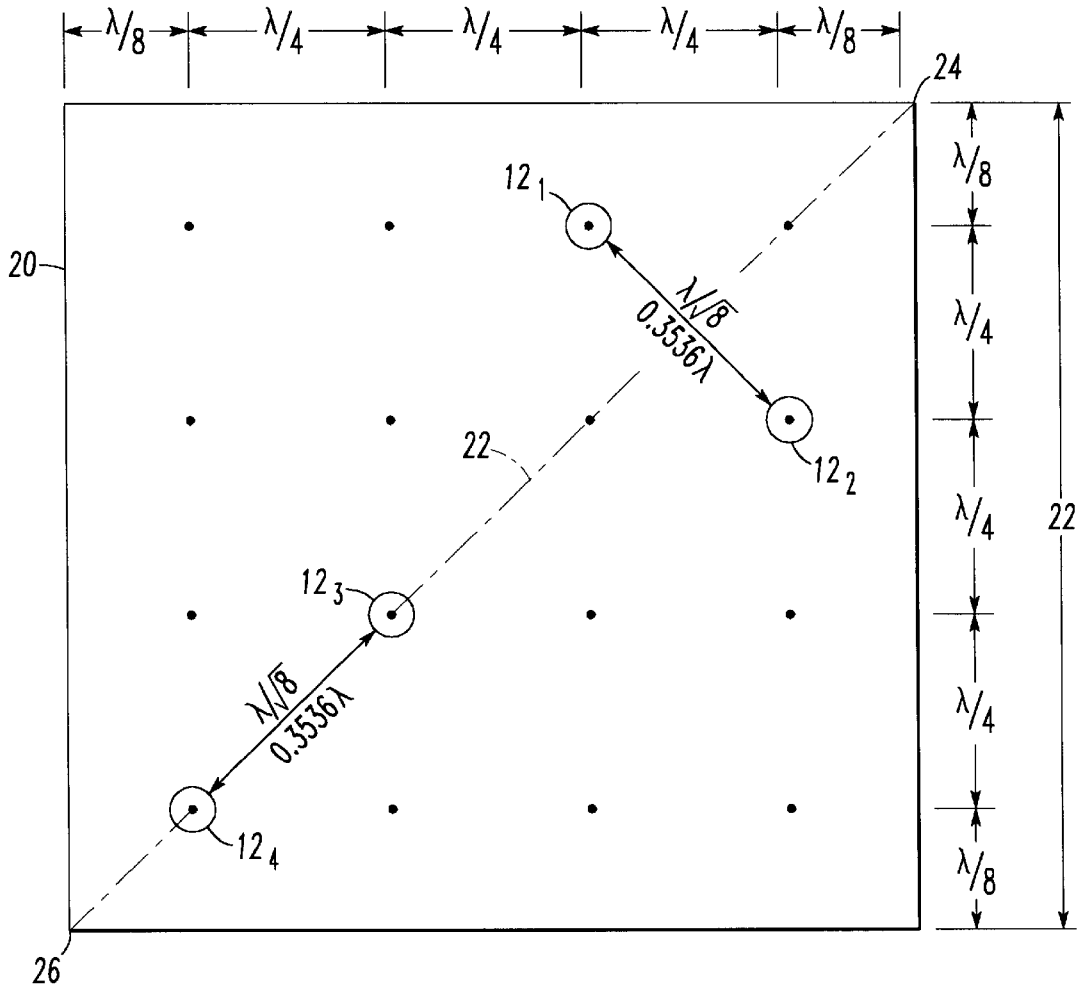
FIG. 5 is an illustration of the tile shown in FIG. 4, further depicting the details of the relative positions and mutual spacing of the antenna elements.
Figure 6:
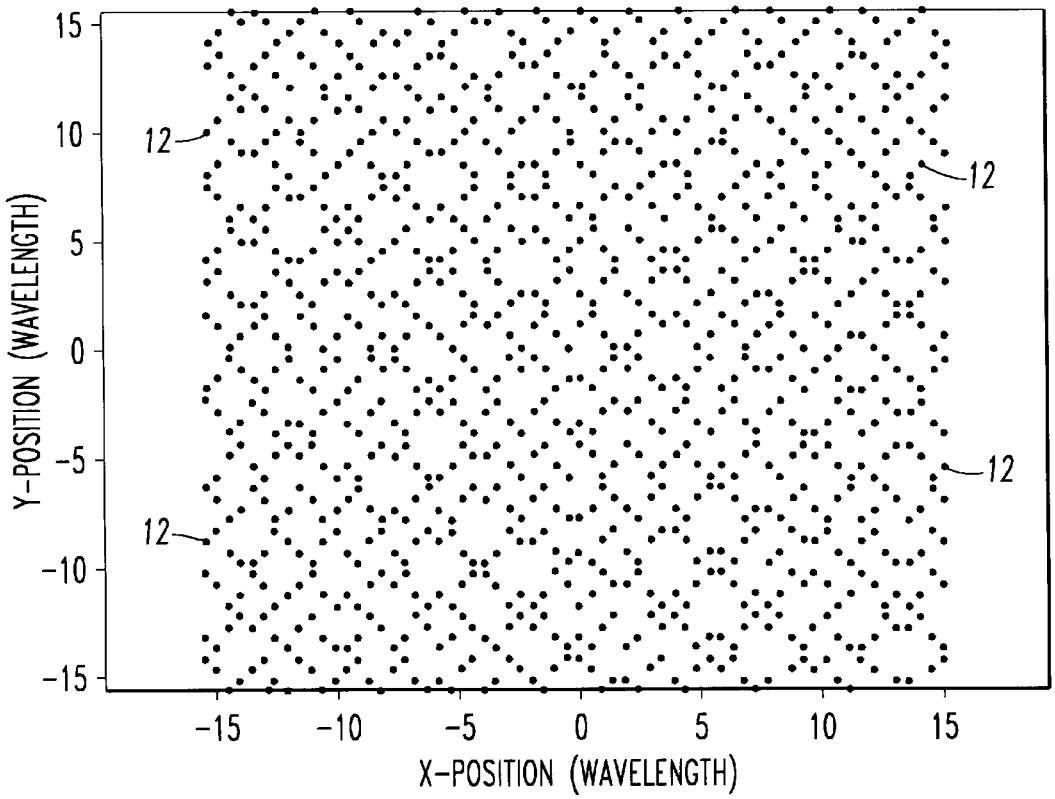
FIG. 6 is illustrative of an irregular array of elements resulting from a random orientation of a plurality of tiles shown in FIGS. 4 and 5.

Such an arrangement is shown, for example, in FIGS. 4–6 where a preferred embodiment of an antenna tile in accordance with the subject invention is depicted. A four element antenna tile 20 having 2λ×2λ side dimensions or four square wavelength is shown in FIGS. 4*a*–4*d* rotated counterclockwise by 90° through four possible orientations. Further as shown, two elements $\mathbf{12}_1$ and $\mathbf{12}_2$ straddle a diagonal line 22 extending between opposite corners 24 and 26 of the tile in the region adjacent the corner 24 and being equally located on either side thereof, while the other two elements $\mathbf{12}_3$ and $\mathbf{12}_4$ are aligned with the diagonal 22 and located in the region adjacent the other corner 26 of the tile 20.

Referring now to FIG. 5, depicted thereat is the tile orientation of FIG. 4*d*, with the relative dimensions associated with the element spacings being shown. The distance between the two pairs of elements $\mathbf{12}_1$, $\mathbf{12}_2$ and $\mathbf{12}_3$, $\mathbf{12}_4$ comprises the hypotenuse of a right triangle having side lengths of λ/4 and thus is equal to $\lambda/\sqrt{8}=0.3536\lambda$. Since there are four elements per file, the effective density is one square wavelength.

It is to be noted that when the elements $\mathbf{12}_1$, $\mathbf{12}_2$, $\mathbf{12}_3$, $\mathbf{12}_4$ are collapsed to a line source in azimuth or elevation, the elements appear to be on a λ/2 grid, although the average spacing in the tile is still one per square wavelength, or one wavelength spacing. When combined with the four different allowed rotations as shown in FIG. 4, collapsing the element positions to a line source along any intercardinal axis also yields an effective sub-wavelength spacing.

Figure 7:
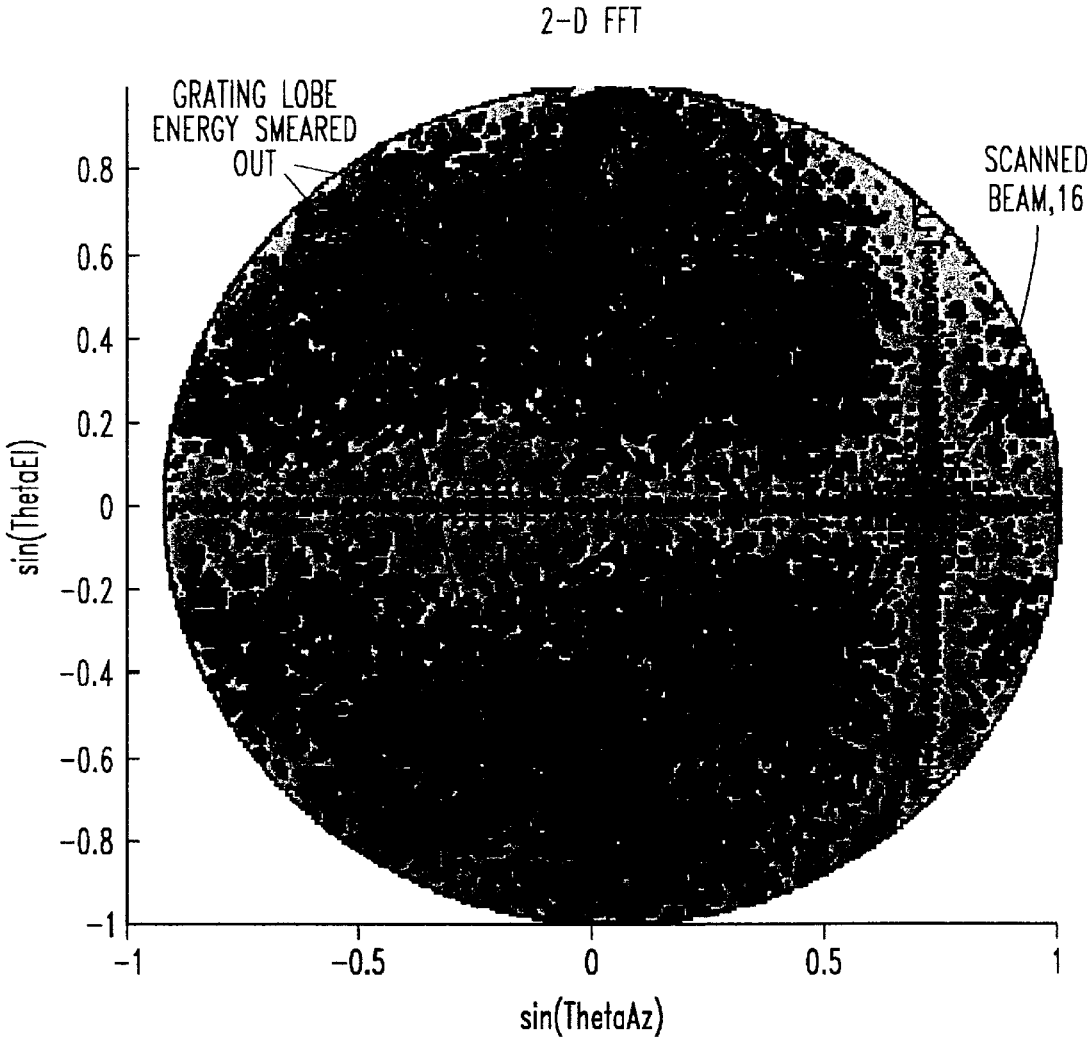
FIG. 7 is illustrative of the resulting grating lobe amelioration achieved with a phased array such as shown in FIG. 6.

As shown in FIG. 6, when the four different allowed tile rotations of FIGS. 4*a*–4*d* are chosen randomly, a 16×16 array of tiles 20 forms an irregular array of 1024 elements on an average one wavelength grid. When such an array is now scanned, for example, 45° in azimuth, the array shown in FIG. 6 has a 2-D FFT as shown in FIG. 7. The grating lobe energy has been ameliorated. The grating lobe energy is not gone, but is now smeared out at a lower power level across a larger solid angle with the resulting peak of the far side lobes being 20 dB or less.

Figure 8:
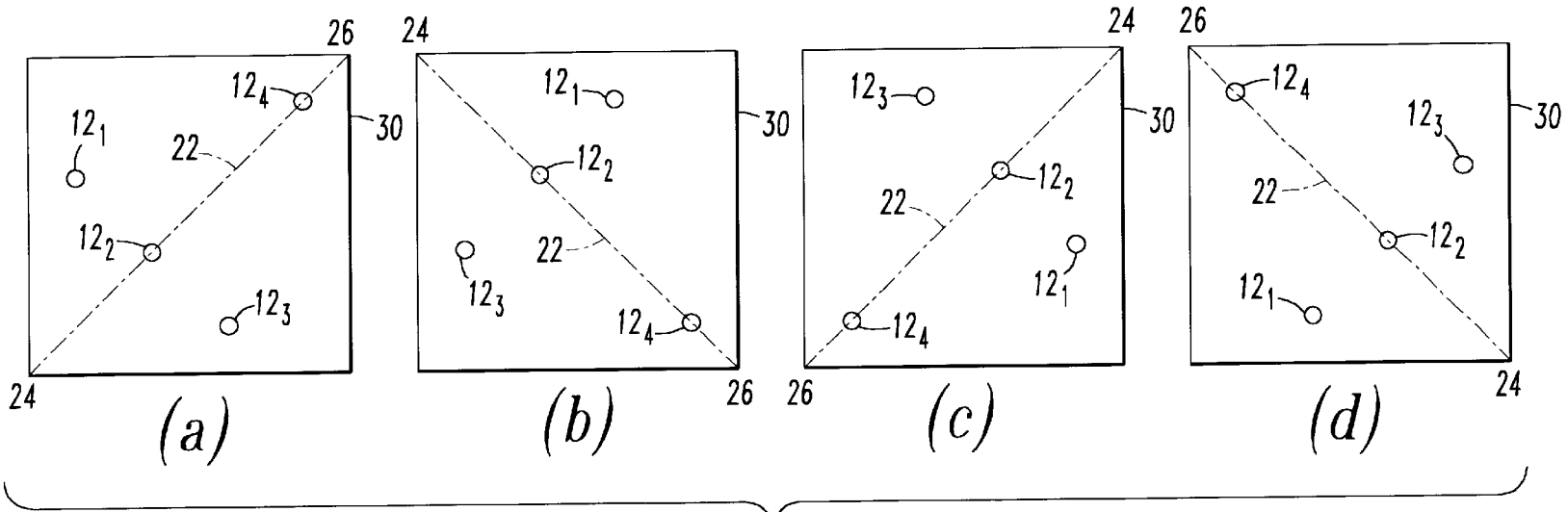
FIGS. 8*a*–8*d* are illustrative of a second preferred embodiment of a four element tile in accordance with the subject invention and four possible 90° rotations or orientations thereof.
Figure 9:
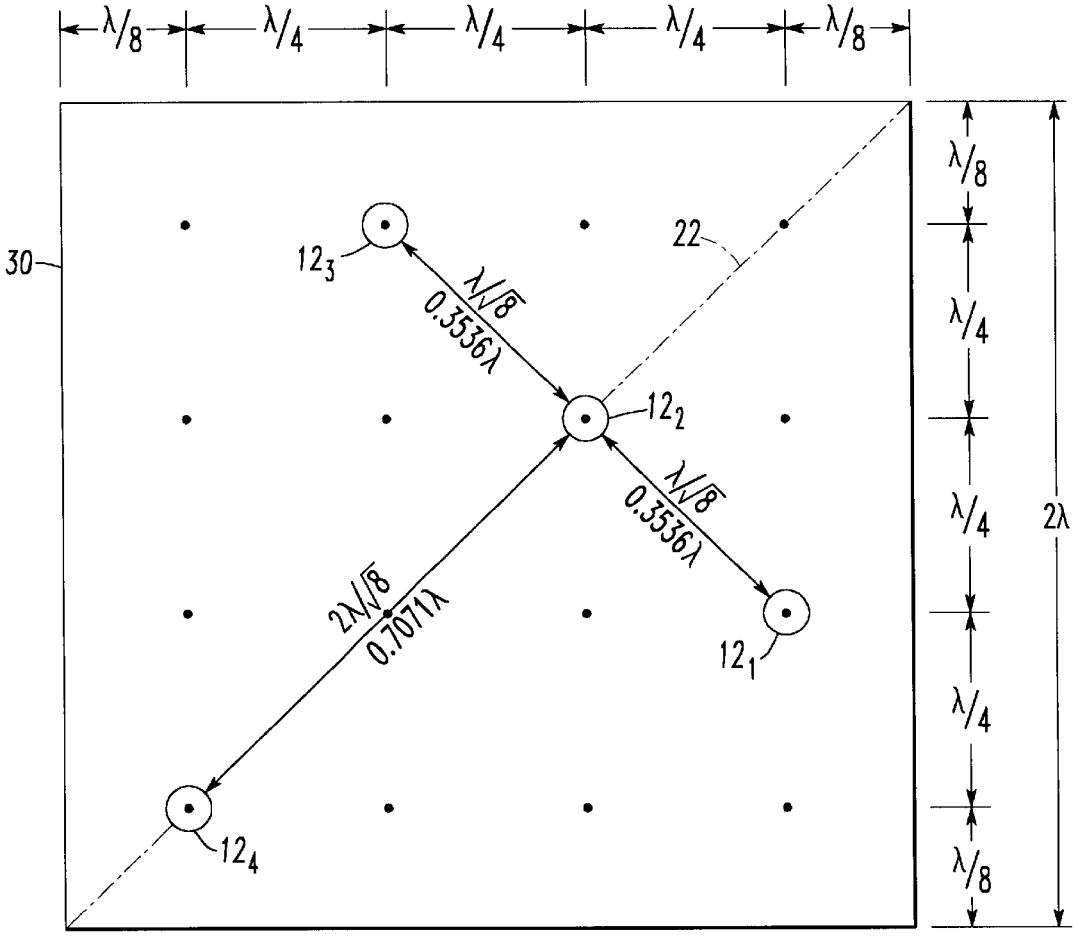
FIG. 9 is illustrative of the relative positions and mutual spacing of the elements in the tile shown in FIG. 8.
Figure 10:
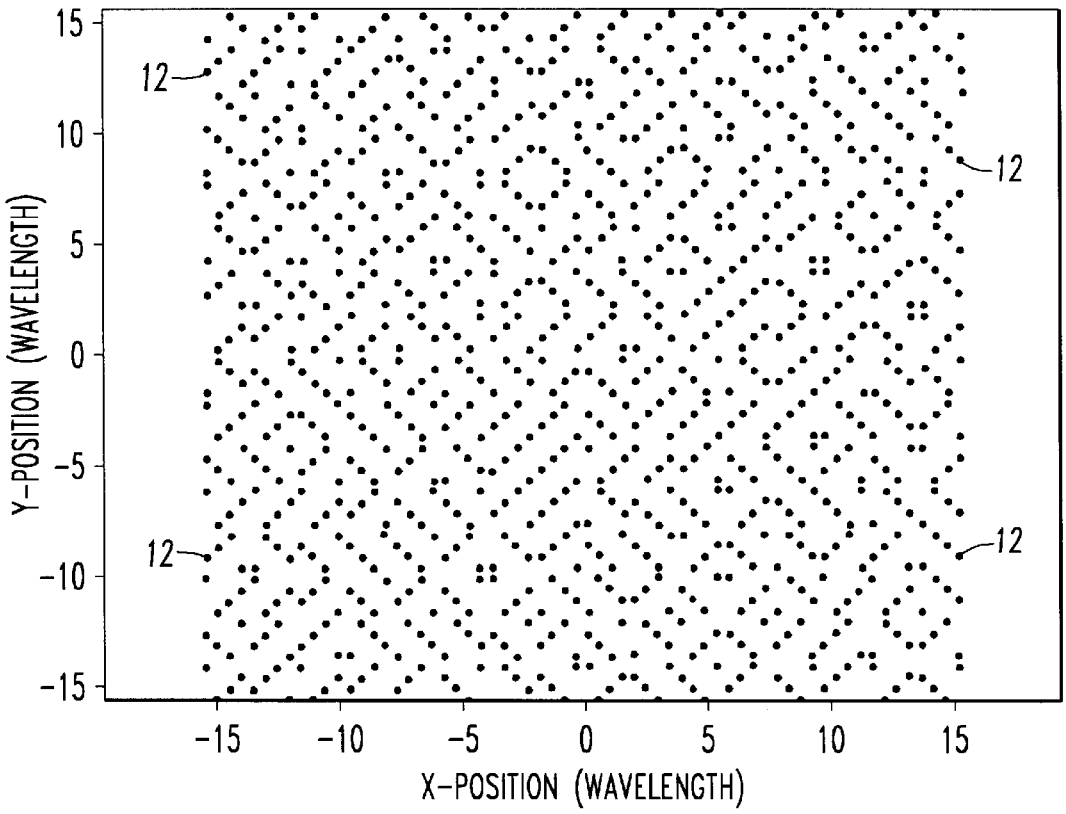
FIG. 10 is illustrative of an irregular array of antenna elements resulting from a random orientation of a plurality of tiles, such as shown in FIGS. 8 and 9.

Considering now FIGS. 8–10, shown thereat is a second preferred embodiment of a four element tile also having side dimensions of 2λ×2λ or four square wavelength as in the first embodiment. However, the location of the four antenna elements $\mathbf{12}_1 \ldots \mathbf{12}_4$ is now changed to one where three of the elements $\mathbf{12}_1$, $\mathbf{12}_2$, and $\mathbf{12}_3$ are linearly aligned perpendicular to the diagonal 22 in the vicinity of the corner 24, while the fourth element $\mathbf{12}_4$ is located in the vicinity of the opposite corner 26. Moreover, two of the elements $\mathbf{12}_2$ and $\mathbf{12}_4$ are positioned along the diagonal 22, but now have a relatively greater spacing as shown in FIG. 9.

As shown in FIG. 9, the distance between elements $\mathbf{12}_1$ and $\mathbf{12}_2$ and between $\mathbf{12}_2$ and $\mathbf{12}_3$ are equal to the hypotenuse of a right triangle having sides of λ/4 and thus being equal to $\lambda/\sqrt{8}=0.3536\lambda$. The distance between elements $\mathbf{12}_2$ and $\mathbf{12}_4$, however, is the hypotenuse of a right triangle having sides of λ/2 and which would be equal to $2\lambda/\sqrt{8}$ or 0.7071λ. Since there are four elements on the tile 30, effective spacing is one wavelength as before with respect to the first embodiment shown in FIG. 5.

Again, it should be noted that when the elements $\mathbf{12}_1$, $\mathbf{12}_2$, $\mathbf{12}_3$ and $\mathbf{12}_4$ on the tile 30 are collapsed to a line source in azimuth or elevation, the elements appear to be on a one half wavelength grid, although the actual average spacing is still one wavelength. When combined with four different allowed rotations as shown in FIGS. 8*a*–8*d*, where four clockwise 90° rotation are depicted, collapsing the line element positions to a line source along any intercardinal axis also yields effective sub-wavelength spacing.

Figure 11:
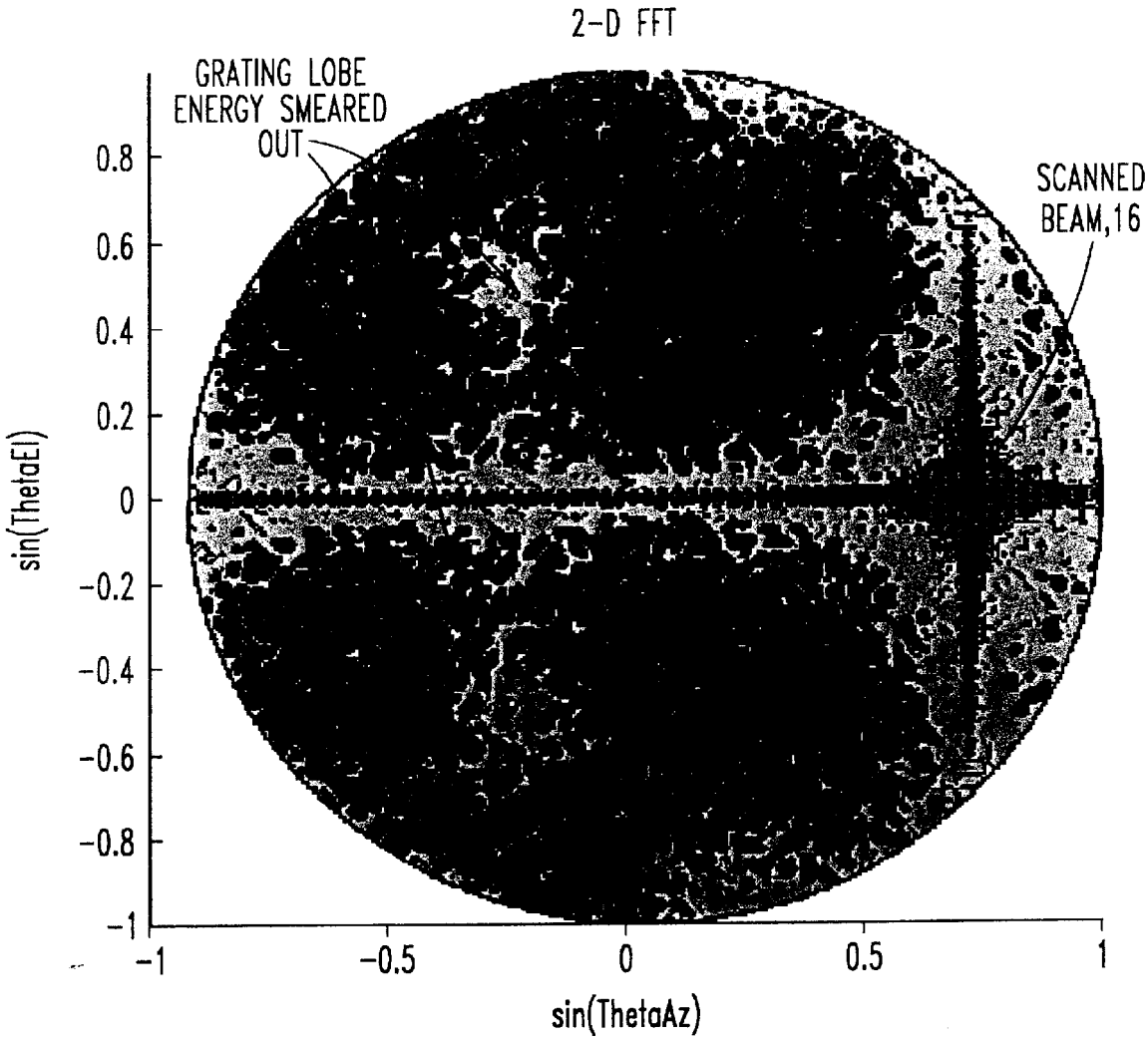
FIG. 11 is illustrative of the resulting grating lobe amelioration achieved with a phased array such as shown in FIG. 10.
Figure 12:
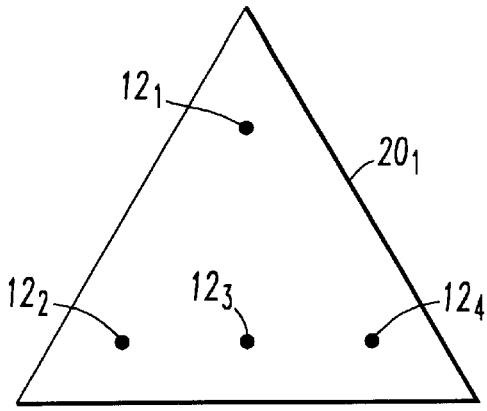
FIG. 12 is illustrative of a triangular tile.

As before, when the four different allowed 90° rotations of the tile 30 are chosen randomly, a 16×16 array of tiles results in an irregular array of 1024 elements on an average one wavelength grid as shown in FIG. 10. When the irregular array of FIG. 10 is scanned, for example 45° in azimuth, the array has a 2-D FFT as shown in FIG. 11. Again, the grating lobe as shown in FIG. 3 has been ameliorated, i.e., is smeared out at a lower power level across a larger solid angle as before.

Figure 13:
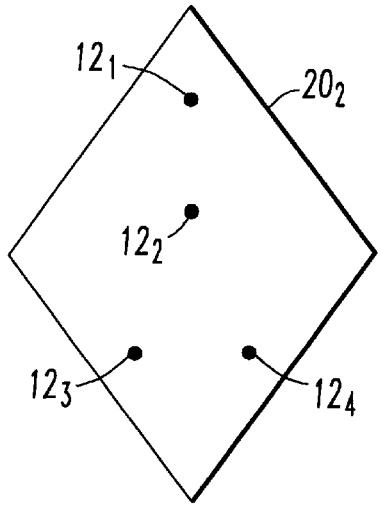
FIG. 13 is illustrative of diamond shaped tile.
Figure 14:
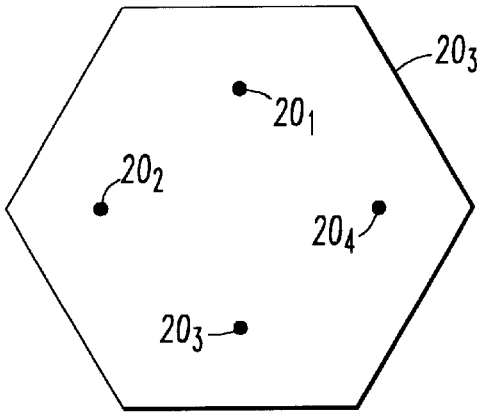
FIG. 14 is illustrative of a hexagonal tile.
Figure 15:
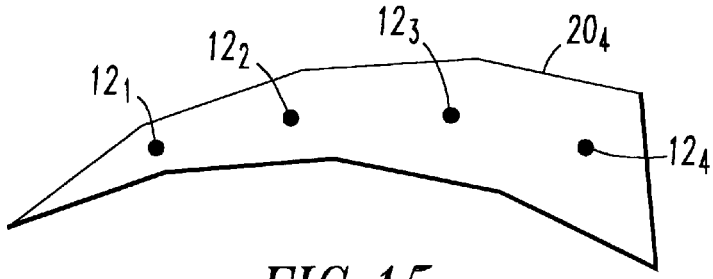
FIG. 15 is illustrative of an arcuate shaped tile consisting of nine straight line segments.
Figure 16:
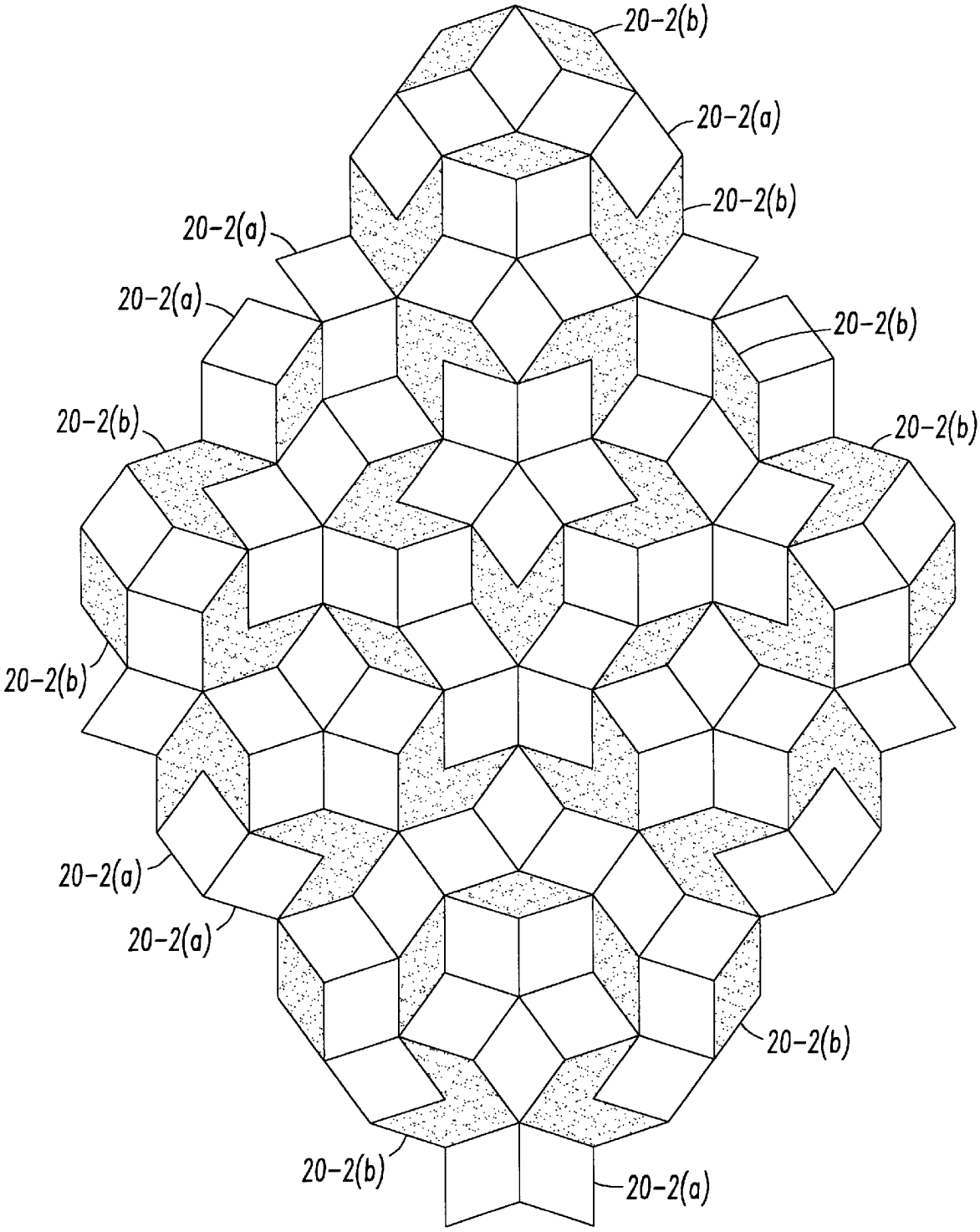
FIG. 16 is illustrative of an array of diamond shaped tiles.
Figure 17A:
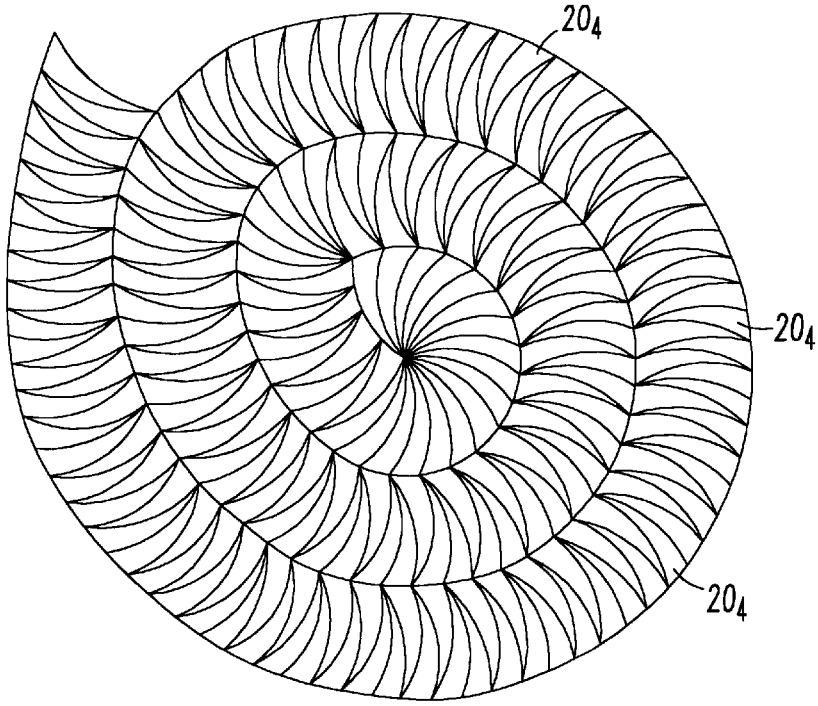
FIGS. 17A and 17B are illustrative of two types of curvilinear arrays comprised of the arcuate tiles shown in FIG. 16.
Figure 17B:
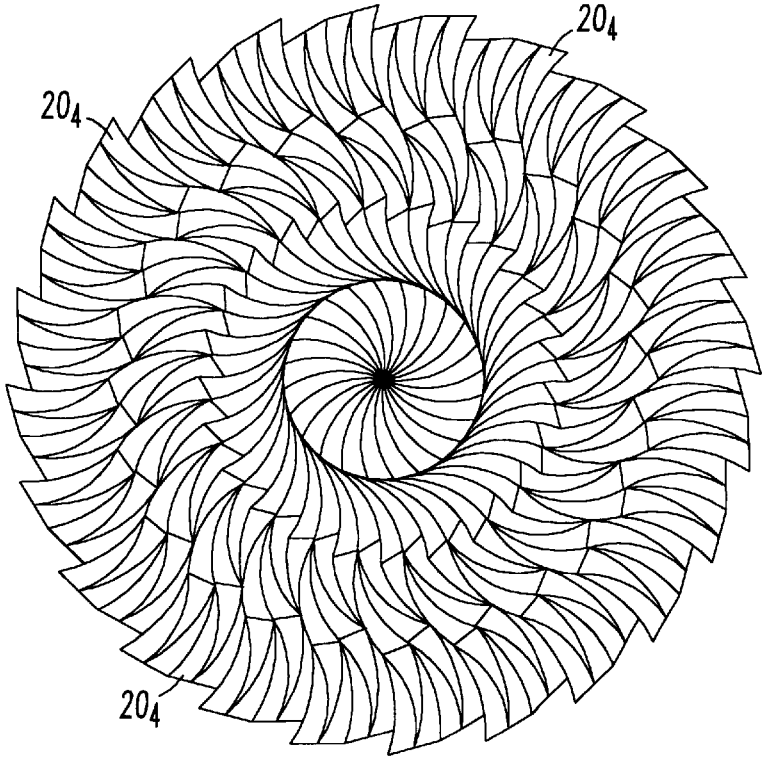

Although what has been described and illustrated herein is a structure consisting of identical square tiles with four elements, it should be noted, that when desirable, any size tile and any desired number of elements per tile may be used, where larger numbers of elements on larger tiles would lead to a greater savings in manufacturing costs. Also, other polygonal tile shapes may be resorted to such as shown, for example, in FIGS. 12, 13, 14 and 15 where a triangular tile 20-1, a diamond shaped tile 20-2 in the form of a parallelogram, a hexagonal tile 20-3, and an arcuate tile 20-4 consisting of nine straight line segments are depicted. FIG. 16 is illustrative of an aperiodic tile arrangement utilizing two different sized diamond shaped tiles 20-2(*a*) and 20-2(*b*) of the type shown in. FIG. 13. FIGS. 17A and 17B, on the other hand, are illustrative of a spiral type tile arrangement and a concentric circular tile arrangement utilizing arcuate shaped tiles shown in FIG. 15. In each instance, an irregular array of antenna elements results which produces grating lobe amelioration.

FIGS. 16, 17*a*, and 17*b*, moreover, illustrate tiling arrangements whereby randomness in element placement comes not only from random orientation of the tiles 20, but also from the inherent translational aperiodicity of the tiling. Also, these tiling arrangements provide more possible orientations for the tiles 20. In FIG. 16, for example, the diamond-shaped tiles 20-2(*a*) and 20-2(*b*) may appear in ten different orientations, and in FIGS. 17*a* and 17*b*, the arcuate tiles 20-4 appear in twenty-four different orientations.

Accordingly, the foregoing detailed description merely illustrates the principles of the invention. It will thus be appreciated that those skilled in the art will be able to devise various arrangements which, although not explicitly described or shown herein, embody the principles of the invention and are thus within its spirit and scope.

What is claimed is:

1. An antenna array, comprising:

a plurality of identical antenna element support members assembled mutually adjacent to one another so as to form an array;

a plurality of antenna elements arranged in a predetermined pattern on each of said support members; and wherein the plurality of support members are arranged in an orientation pattern so as to form an irregular array of antenna elements and thereby provide grating amelioration.

2. The antenna array as defined by claim 1 wherein said support members comprise tiles of a predetermined size and shape.

3. The antenna array as defined by claim 2 wherein said tiles have substantially linear side edges.

4. The antenna array as defined by claim 2 wherein said tiles have a plurality of side edges which form a geometrical figure.

5. The antenna array as defined by claim 4 wherein said geometrical figure comprises a regular polygon.

6. The antenna array as defined by claim 5 wherein said polygon comprises a quadrilateral.

7. The antenna array as defined by claim 5 wherein said polygon comprises a triangle.

8. The antenna array as defined by claim 5 wherein said polygon comprises a hexagon.

9. The antenna array as defined by claim 5 wherein said polygon describes an arcuate figure consisting of a plurality of straight line segments.

10. The antenna array as defined by claim 2 wherein said tiles are substantially square in shape.

11. The antenna array as defined by claim 10 wherein said tiles each includes at least four antenna elements.

12. The antenna array as defined by claim 11 wherein said tiles permit four different orientations thereby.

13. An antenna array as defined by claim 12 wherein said tiles are assembled together with random orientations.

14. The antenna array as defined by claim 13 wherein each of said tiles comprises a tile member including four antenna elements located thereon and wherein a first two elements of said antenna elements are aligned with a diagonal of the tile member and a second two elements of said antenna elements straddle the diagonal of the tile member.

15. The antenna array as defined by claim 14 wherein the first two elements are located in a region adjacent one corner of the tile member and the second two elements are located in a region adjacent a corner opposite said one corner of the tile member.

16. The antenna array as defined by claim 15 wherein the elements of said first and second two elements are mutually separated by a distance equal to the hypotenuse of a right triangle having adjacent sides equal to a quarter wavelength or $\lambda/4$, where $\lambda$ is equal to wavelength.

17. The antenna array as defined by claim 15 wherein the elements of said first and second two elements are mutually separated by a distance of about $\lambda/\sqrt{8}$, where $\lambda$ is equal to wavelength.

18. The antenna array as defined by claim 13 wherein each of said tiles includes four antenna elements located thereon and wherein a first two elements of said antenna elements are aligned with a diagonal of a tile member and a second two elements of said antenna elements are equally located on either side of the diagonal and aligned with one element of said first two elements.

19. The antenna array as defined by claim 18 wherein said one element of said first two elements and said second two elements are located in a region adjacent one corner of said tiles and the other elements of said first two elements is located in a region adjacent the opposite corner from said one corner of said tiles.

20. The antenna array as defined by claim 18 wherein the first two elements are mutually separated by a distance equal to the hypotenuse of a right triangle having adjacent sides equal to one half wavelength or $\lambda/2$, where $\lambda$ is equal to wavelength, and wherein the second two elements are mutually separated from said one element of said first two elements by a distance equal to the hypotenuse of a right triangle having adjacent sides equal to a quarter wavelength or $\lambda/4$.

21. The antenna array as defined by claim 18 wherein the first two elements are mutually separated by a distance equal to about $2\lambda/\sqrt{8}$ where $\lambda$ is equal to wavelength, and wherein the second two elements are mutually separated from said one element of said first two elements by a distance equal to about $\lambda/\sqrt{8}$.

22. An antenna array, comprising:

a plurality of generally square antenna tile members placed adjacent one another so as to form an array of antenna elements;

four antenna elements arranged in a predetermined identical pattern on each of said tiles; and wherein the plurality of antennas are arranged in an orientation pattern so as to form an irregular array of antenna elements so as to provide grating amelioration.

23. The antenna array as defined by claim 22 wherein a first two elements of said antenna elements are aligned with a diagonal of each of said tile members and a second two elements of said antenna elements straddle the diagonal thereof.

24. The antenna array as defined by claim 23 wherein the first two elements are located in a region adjacent one corner of said tile members and the second two elements are located in a region adjacent a corner opposite said one corner of said tile members.

25. The antenna array as defined by claim 22 wherein a first two elements of said antenna elements are aligned with a diagonal of each of said tile members and a second two elements of said antenna elements are equally located on either side of the diagonal and aligned with one element of said first two elements.

26. The antenna array as defined by claim 25 wherein said one element of said first two elements and said second two elements are located in a region adjacent one corner of the tile member and the other element of said first two elements is located in a region adjacent the opposite corner from said one corner of the tile member.

* * * * *